US005177870A

United States Patent [19]

Jursich et al.

[11] Patent Number: 5,177,870

[45] Date of Patent: Jan. 12, 1993

[54] SHOWER SHAVER

[75] Inventors: Donald N. Jursich, Chicago; Donald J. Kempiak, Palatine; William Kalnins, Maple Park; Jefferson L. Gentry, Deerfield, all of Ill.

[73] Assignee: Associated Mills, Chicago, Ill.

[21] Appl. No.: 656,774

[22] Filed: Feb. 15, 1991

Related U.S. Application Data

[63] Continuation-in-part of Ser. No. 607,302, Oct. 31, 1990, Pat. No. 5,075,969, which is a continuation-in-part of Ser. No. 501,029, Mar. 29, 1990, Pat. No. 4,995,155.

[51] Int. Cl.[5] ..... B26B 19/48; B26B 19/40

[52] U.S. Cl. ..... 30/41; 30/41.5

[58] Field of Search ..... 30/41, 41.5; 224/232, 224/253; 285/401, 402, 396, 398

[56] References Cited

U.S. PATENT DOCUMENTS

| | | | |
|---|---|---|---|
| 3,449,000 | 6/1969 | Kane | 285/402 |
| 3,599,847 | 8/1971 | Danielson | 224/253 |
| 4,177,556 | 12/1979 | Galli, Jr. | 30/41 |
| 4,228,586 | 10/1980 | Thiery | 30/41 |
| 4,633,585 | 1/1987 | Whitaker et al. | 30/41 |
| 4,684,047 | 8/1987 | Burgwin | 224/253 |
| 4,690,316 | 9/1987 | Peterson | 224/253 |
| 4,733,468 | 3/1988 | Zadro | 30/41.5 |

FOREIGN PATENT DOCUMENTS

| | | | |
|---|---|---|---|
| 779700 | 4/1935 | France | 285/175 |

*Primary Examiner*—Douglas D. Watts
*Assistant Examiner*—Paul M. Heyrana, Sr.
*Attorney, Agent, or Firm*—Laff, Whitesel, Conte & Saret

[57] ABSTRACT

A shower shaver is made from two plastic piece parts. A first part is a handle in the nature of a pipe terminating in a cavity. The other piece part delivers water which strikes a razor blade and then exits under the cutting edge of the blade with enough force to wash debris away from the blade. A valve on the shaver handle provides a continuously variable control over the flow of water to the shaver. A tubing or hose attached to the shower shaver leads to a nipple which may be interposed between an outlet and a pipe. A quick disconnect connector enables the tubing to be connected to or disconnected from the nipple. A bracket or hanger is attached to a wall in any suitable out of the way location in order to receive and support the shaver when the shaver and the quick disconnect connector on the tubing is not in use.

17 Claims, 4 Drawing Sheets

SHOWER SHAVER

This is a continuation-in-part of Ser. No. 07/607,302, U.S. Pat. No. 5,075,969 issued Dec. 31, 1991 filed Oct. 31, 1990, which in turn was a continuation in part of Ser. No. 07/501,029 filed Mar. 29, 1990, U.S. Pat. No. 4,995,155 issued Feb. 2, 1991.

This invention relates to razors and the like for use in showers and more particularly, to shower shavers.

Many people, primarily women, like to use razors while in a shower, and preferably while water is running over an area of skin which is to be shaved. This use leads to some rather complex problems which may be solved by connecting a razor through a tubing to a plumbing pipe which delivers a steady stream of water to and past the cutting blade. A few examples pertinent to such devices are found in U.S. Pat. Nos. 1,938,481; 2,336,806; 4,077,119; 4,177,556; 4,205,441; 4,228,586; 4,370,807; 4,633,585; and British Patent No. 541,723; 597,918.

A primary reason for using a razor having a blade which is wetted by a flowing stream of water grows out of various things such as the frequency of shaving, the angle of the razor for any given usage, and the comfort of the shaver. In general, an infrequent shaver tends to have tender skin. Therefore, the flowing water tends to make the act of shaving less irritating to the skin.

It is important to have the pattern of water flowing through the razor distributed in a manner which gives the best shaving results. The ability to use any of many commercially available razor blades, and the like, is also important. Another consideration is the cost of manufacture since a razor has tended to become almost a disposable item. Therefore, the cost of manufacture, ease of assembly, and the like are important considerations if the product is to be commercially successful.

Yet another consideration relates to peripheral matters such as the ease of installing the shower shaver water tubing in existing plumbing. The convenience of storing the razor in a handy-but-out-of-the-way place when not in use is quite important. The installation should provide an easy operation of a water valve for supplying water to the razor or to a shower head. Still another consideration is to provide a continuously variable valve which may direct all, some, or little water to the razor and the rest out of the shower head in order to have a desired amount of water for both the shaver and the shower head.

A quick disconnect attachment provides an additional benefit for the European and other non-U.S. markets which have the shower plumbing emerging from the wall at the tub fittings as distinguished from having a plumbing pipe emerging from a wall at an overhead showerhead. From such a low level of plumbing connection, it is not practical to have a long hose hanging into the tub or shower. In such situations, the hose should preferably be removed after each use.

Some users of the shower shaver do not like the hose hanging from the shower fixture since the consider it to be unsightly, awkward or in the way. Also, the hanging hose may be easily grasped by children, perhaps resulting in the shaver and its sharp blade falling into a bath tub containing the child.

Accordingly, an object of the invention is to provide new and improved means for and methods of shower shaving. Another object is to provide shower shavers with superior water distribution patterns.

Still another object of the invention is to provide removable shower shavers. In particular, an object is to accommodate shower shavers to non-U.S. types of shower plumbing which emerges from a wall near a bath tub level. Here, an object is to provide a shower shaver with a water flow control in the razor itself.

In keeping with an aspect of the invention, the shower shaver is made from at least two plastic piece parts which are bonded together. A first part is a handle in the nature of a pipe terminating in a fan-shaped or flared, tray like top surface. Another piece part is a cover or top which fits over and cooperates with the tray top to form a cavity which delivers a flared sheet of water toward an orifice which exits under the edge of the blade.

If provided, a third part of the razor contains a water flow control valve which allows the user to adjust the rate of water flow from the shaver itself while holding the handle. The benefits of a water flow control at the handle are especially valuable when the shaver is used with the European type of plumbing fixture.

Although all embodiments of the inventive shower shaver show a pliable hose which may be removed and stored away from the shower, a repeated removing of the hose without a special quick disconnect connector from the water flow assembly eventually results in the hose leaking. With the embodiment which incorporates such a connector, the hose may be easily removed and replaced frequently. This embodiment also includes a separate hanging rack, which is affixed with a "Velcro" hook and loop fastener to any suitable wall. This rack provides a holder for storing the hose and shaver at any convenient location.

A preferred embodiment of the invention is shown in the attached drawings, wherein.

Figures 1, 2, 3, 4:
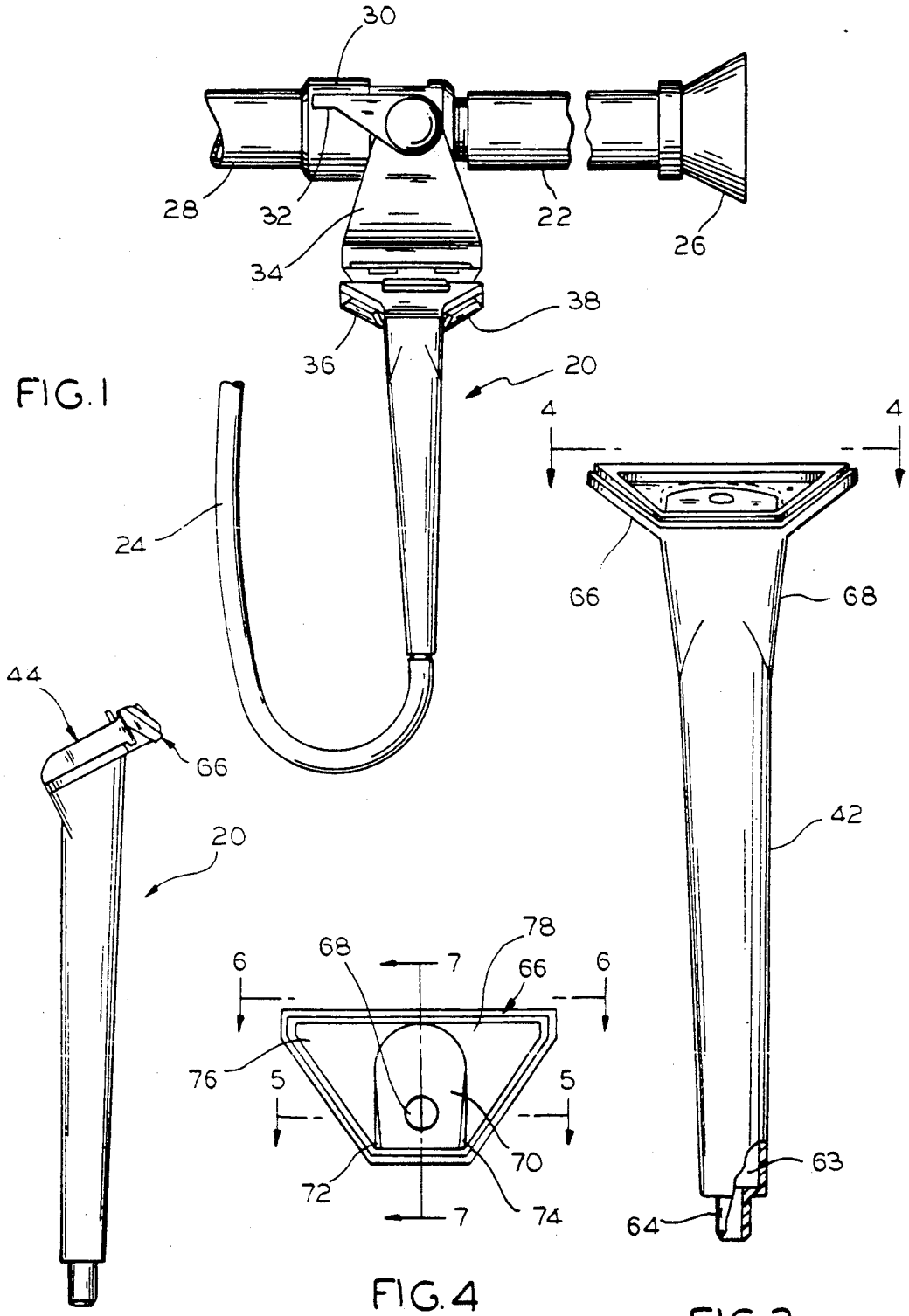
FIG. 1 is a back elevation of the inventive razor hanging on a bracket attached to a nipple coupled between a shower head and a plumbing pipe.
FIG. 2 is a side elevation of the inventive razor.
FIG. 3 is a back elevation of the handle part of the inventive razor.
FIG. 4 is a top plan view of the handle part of the razor taken along line 4—4 of FIG. 3.
Figure 5:
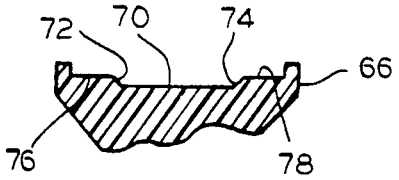
FIG. 5 is a cross-section taken along line 5—5 of FIG. 4.

In FIG. 1, the inventive razor 20 is coupled to a nipple, valve, and hanger assembly 22 by a thin walled tubing 24. The nipple is installed by removing the shower head 26 from a plumbing pipe 28 which is normally a permanent part of the household plumbing. Thereafter, an end 30 on the nipple is turned onto the plumbing pipe 28 and the shower head 26 is placed on the opposite end of the nipple 22. The nipple includes a valve controlled by lever 32 which may divert some, all or none of the water to either the shower shaver 20 or the shower head 26.

Preferably, the tubing is long and thin walled to provide a flexible and pliable construction which enables the shaver to be positioned in any desired manner during use. This may be accomplished by a polyvinyl chloride (PVC) tubing made of FDA approved food grade material. The tubing should be in the order of seven to nine feet long, with eight feet preferred. The tubing wall thickness is in the range of 0.025 to 0.035 inches, with a 0.030 inches preferred. The inside diameter is in the range of 3/32 to 7/32 inches with 5/32 inches preferred. The durometer is in the range of 75–85, with 80 preferred.

This very thin wall thickness and long length provides a maximum flexibility and results in a low mass which makes it easy to wield the shaver. The long reach of the tubing provides a maximum reach for the razor. Hence, there is such a flexibility and ease of use that no special swivel or other fitting is required. The clear plastic enables the user to see any blockage or build up which may occur in the tubing.

A hanger 34 fits over a shaft extending to the valve and is held in place by the valve operating lever 32. The hanger is free to rotate on the shaft so that it hangs under the effect of gravity acting on its weight regardless of the angles of the plumbing pipe. The bottom of the hanger has two upturned ears 36, 38 for retaining the razor when it is hung up.

The internal construction of the razor 20 is best seen in FIGS. 2–7. Essentially, the razor itself is made of two plastic piece parts 42, 44, plus a commercially available razor blade 46. The blade 46 (FIG. 7)has two tracks 48, 50 which slide over two guide rails 52, 54 above and below water issuing passages 56–62. The razor blade may be any commercially available device, such as those shown in U.S. Pat. Nos. 3,786,563 and 3,832,774.

The handle part 42 is, in part, a hollow tube 63 extending from an end fitting 64 to a tray-like shape 66 at the top of the handle. The tubing 24 is attached to the end fitting 64, by any suitable means. The hollow tube 63 ends in an exit opening 68 in a depression 70 at the center of the upper surface of the tray member 66. The depression 70 has sloping side walls 72, 74 leading to a truncated triangular plane or land 76, 78 (FIG. 4). Thus, when the valve 32 on nipple 22 is opened, water flows through tube 63, into handle 42, and out an opening at the upper tray shape 66. The shape, dimensions, and construction of the tray shape is seen in FIGS. 4–7.

The second plastic piece part forming the razor body is a top or cover 44. The cover fits over the tray-like member 66 where it is bonded in place. The front wall 80 of the cover 44 includes four orifices or holes 56, 58, 60, 62 through which the water may stream from the razor toward the blade. The cover provides essentially a smooth interior surface over the tray 66 in order to complete a fan shaped chamber for directing a sheet of water in a forward direction toward the confronting surface razor blade 46.

In greater detail, the lower surface of the cover part 44 cooperates with the upper surface of the tray to form a somewhat fan-shaped cavity directed at the blade. The hollow tube 63 has an exit 68 which communicates into the small end of the fan shape. The blade orifices 56–62 are at the wide end of the fan shape. This configuration gives the water emitted through opening 68 a smooth transition into a flowing triangular sheet of water directed forwardly, out of the front of the razor, striking the broad flat surfaces of the blade from which it is deflected under the cutting edges of the blade.

Figure 7:
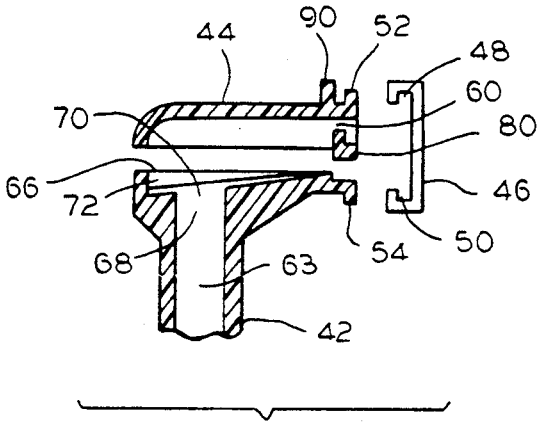
FIG. 7 is an exploded side elevation, in cross-section, of the handle and cover parts, and a razor blade taken along line 7—7 of FIG. 4.
Figure 7B:
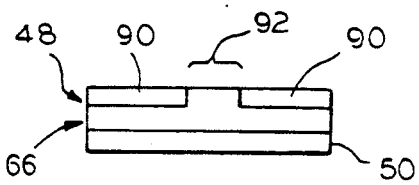
FIG. 7B is a cross-section view of a razor blade.
Figure 7A:
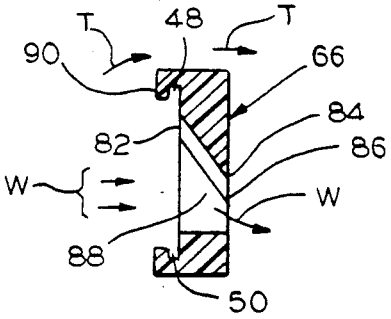
FIG. 7A is a top plan view of a razor blade.

FIG. 7A shows a stylized razor blade 46 in cross-section which is representative of many commercially available blades. The blade itself is a sheet of metal 82 folded to a somewhat U-shape with two sharpened edges 84, 86 at the open edges of the U-shape. An open space 88 is below the blades so that the water represented by arrows W flow under the blades and wet the skin just ahead of the cutting edges. Water cannot enter either the back of the U-shaped blade or fold over the top of the blade which is embedded in plastic.

FIG. 7B shows a stylized back of some of the commercially available blades 46. The discontinuous track 48 is formed behind track guides 90, 90 with a notch 92. Therefore, water may issue from this notch and squirt back toward the face of the user. To forestall such a possibility that the user may be squirted in the face, behind the notch 92 and on top of the cover 44, there is an upstanding fence or deflector 90 which redirects the water from notch 92 away from the user, and preferably in a forward direction toward the skin being shaved. This redirected water flow is indicated by the arrows T, T in FIG. 7A.

Figure 8:
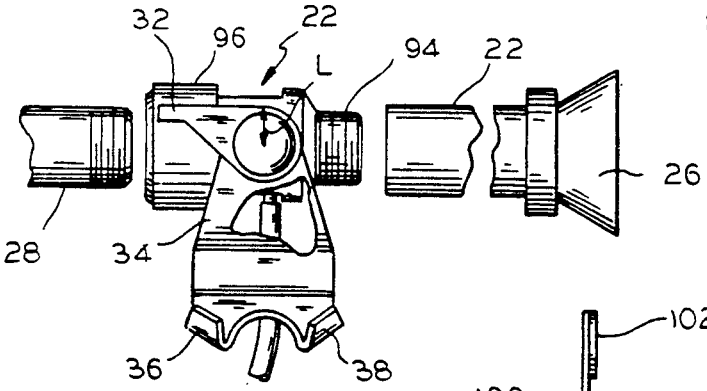
FIG. 8 is a side elevation of a nipple, valve, and hanger assembly used to install the shower shaver in a plumbing line.

The details of the nipple 22 are shown in FIG. 8. More particularly, a plastic pipe has threads 94 on one end and a coupler 96 on the opposite end. The shower head 26 fits on one end and the plumbing pipe 28 receives the other end of the nipple 22. The valve inside the nipple may be any suitable device (such as a stopcock) controlled by rotating a shaft. The shaft position is selected by a handle 32 which is off-set by a distance "L" from the center of rotation, thus providing a lever arm which makes it easy to rotate the valve, even when there is a high water pressure. The valve is continuously variable from one position which directs all water out the shower head 26 and another position which directs all water out the tubing 22 to the shower shaver. In between, water flows out both the shower head 26 and the tubing 22 in varying degrees that are selected by the valve position.

Figure 10:
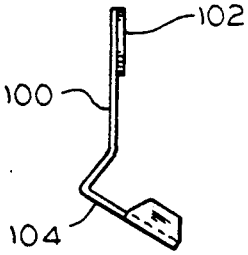
FIG. 10 is a side elevation view of the hanger.
Figure 9:
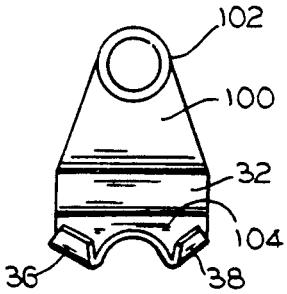
FIG. 9 is a front elevation view of the hanger.
Figure 11:
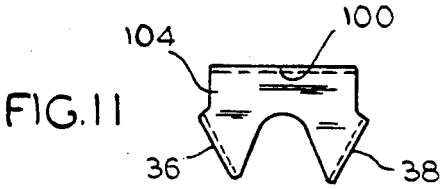
FIG. 11 is a plan view of the hanger.

Behind the handle 32 and freely rotating on the shaft of the valve is a hanger 34, which is shown in detail in FIGS. 9–11. In greater detail, the hanger 32 is preferably a molded plastic part which is an arm 100 having a hole 102 in one end and a flat part 104 terminating in oppositely disposed ears 36, 38 for receiving and capturing the razor. The shaft of the valve passes freely through the hole 102; therefore, regardless of the preexisting angle of plumbing pipe 28, the hanger 100 always hangs downwardly under gravity. The head of the razor sets on part 104 and behind ears 36, 38.

Figure 12:
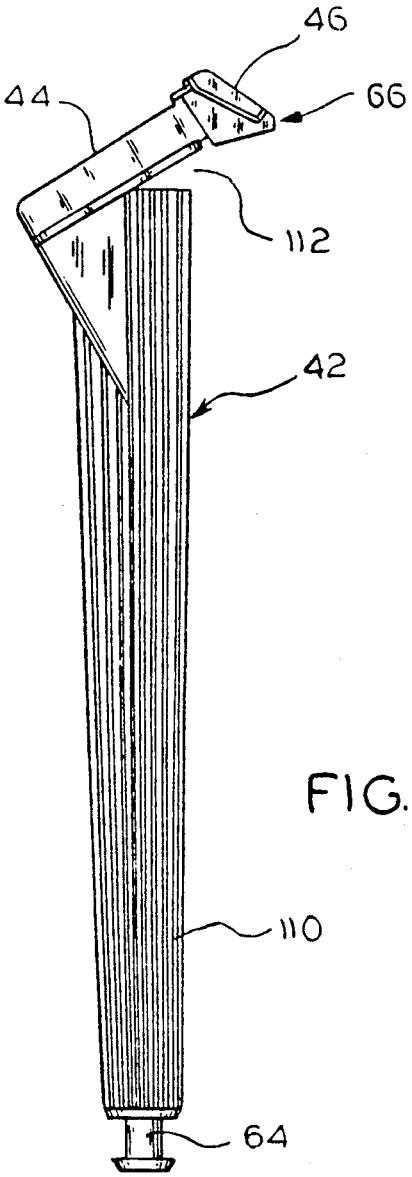
FIG. 12 is a side elevation of a second embodiment of the invention showing a notch for directing a stream of water against the skin, in front of the advancing razor.
Figure 13:
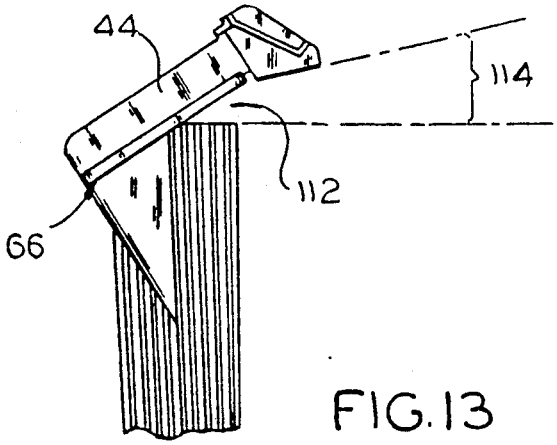
FIG. 13 is a side elevation showing the stream of water issuing from the notch of the embodiment of FIG. 12.
Figure 14:
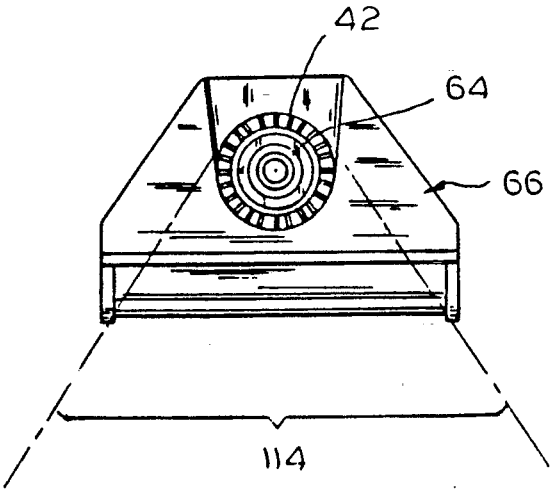
FIG. 14 is a bottom plan view showing the stream of water issuing from the notch of the embodiment of FIG. 12.

A second embodiment of the invention is shown in FIGS. 12–14. The parts in these figures are substantially the same as the corresponding parts shown in the preceding figures except for longitudinal grooves 110 along the length of the handle and a notch 112 in the top of the handle. The grooves 110 make it easier to hold the razor when one is in a shower with wet and perhaps soapy hands.

Figure 6:
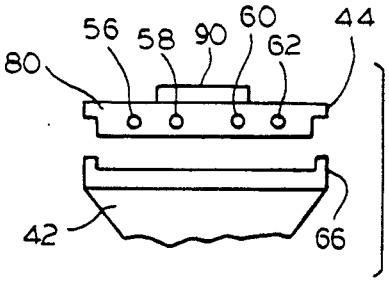
FIG. 6 is an exploded front elevation view of the handle and cover parts taken along line 6—6 of FIG. 4.

The notch 112 has a "V" or wedge shape and is merely cut into the handle at a location immediately below the blade 46. Since the edge of the blade is set to cut the user's hair when the handle is pulled downwardly (as seen in FIG. 12), the stream of water 114 (FIGS. 13, 14) issuing from the notch 112 sprays the skin in front of the advancing blade. The size of the notch 112 is selected as a function of the size of the holes 56–62 (FIG. 6). The water issuing through holes 56–62 should be adequate to wash the debris from the blade, but not enough to push the skin away from the blade, cause a spray out the ends of the razor blade, etc. Once the desired amount of water is issuing through holes 56–62 is selected, the notch 112 is made large enough to drain away all remaining water that can pass through the tubing 24 at normal water pressure.

The tube forming handle 42 is directed toward the underside of the tray-like member 66. Therefore, the stream of water strikes the under, outside surface of member 66 which guides and directs it along the truncated triangular shape of the tray formed at the top of the handle. As a result, a fan shaped sheet of water approximately the width of the blade strikes the skin.

In the embodiment of FIGS. 15–20, the one piece handle 42 of FIGS. 1–14 is replaced by two-piece parts 202, 204, which are joined at screws threads 206, 208. An O-ring 210 seals together the parts 202, 204 and prevents water leakage through the threads. A suitable valve seat 212 receives a rotor 214 of a stop-cock valve which may be rotated by knob 216 to any suitable setting between a valve open and a valve closed portion. A suitable 0-ring 218 seals the rotor 214 to the valve seat 212. Thus, by turning knob 216, any suitable amount of water may be made to flow through the passageway 220, 222 in the handle.

It should be noted that the opening 222 is in the form of a pipe having a length 223. It has been found that a pipe of this length is necessary to assure a straight stream of water directed toward the cavity above plate 66, under all settings of valve 214. Without the pipe, a barely open valve 214 would emit a spray from one side of the opening 222, which would cause eddy currents, misdirected water, etc. causing an interference in the water flow which would be less than desirable. With the pipe, the water flow is properly spread across the blade at all valve settings.

Figures 15, 16, 17, 18, 19, 20:
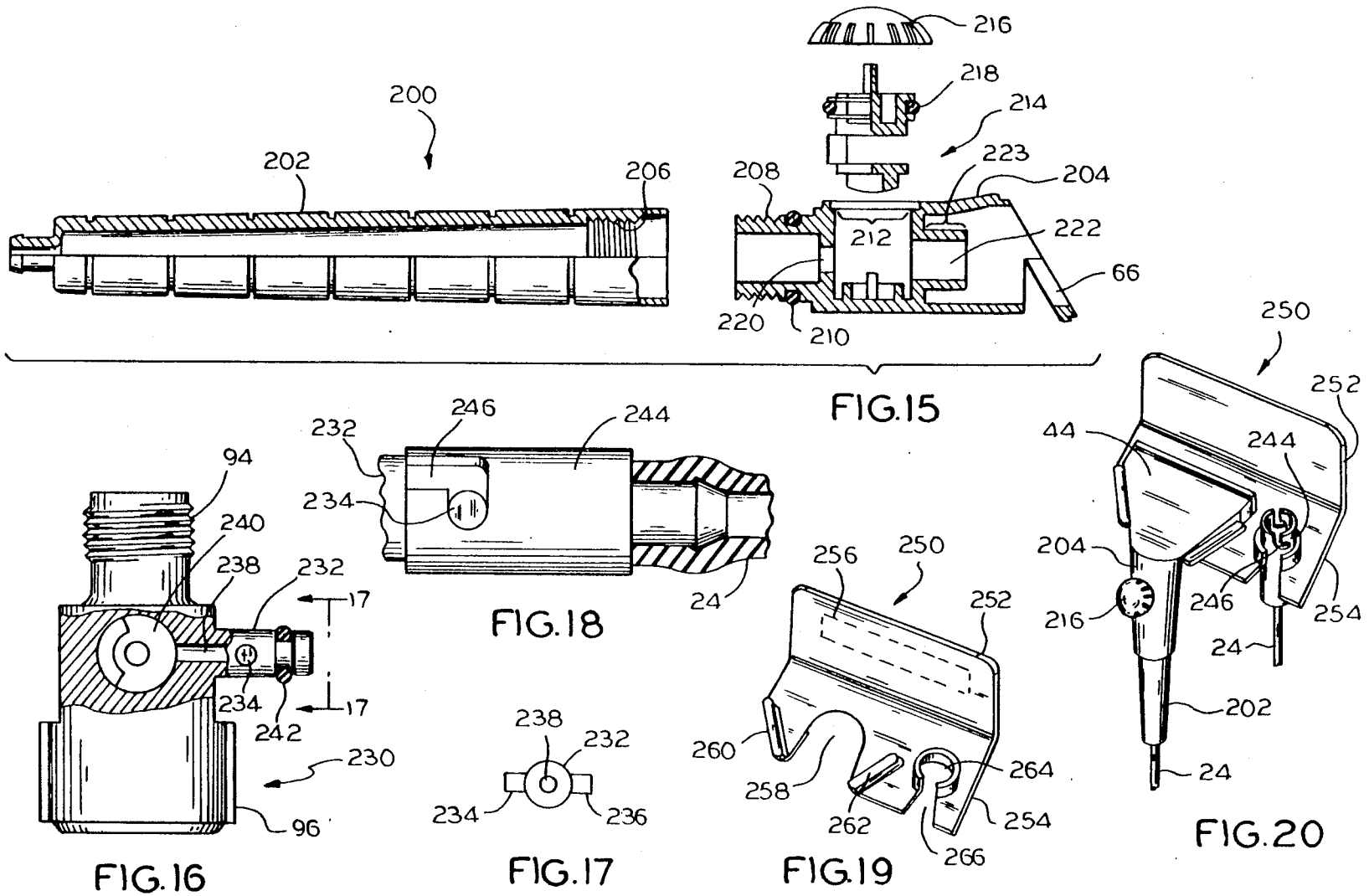
FIG. 15 is a side elevation (partially in cross-section) which shows an exploded part of the shaver handle of a third embodiment.
FIG. 16 shows an alternative nipple for providing a quick disconnect bayonet fitting.
FIG. 17 is an end view of the bayonet fitting taken along line 17—17 of FIG. 16.
FIG. 18 is a side elevation of a mating bayonet fitting attached the end of a shower shaver hose.
FIG. 19 shows an alternative bracket or hanger for remote storage of the shower shaver.
FIG. 20 shows the shaver stowed in the hanger of FIG. 18.

FIG. 16 shows a nipple 230 which may be used in place of the nipple 22 of FIG. 8. In FIG. 8, the nipple 22 is more or less permanently connected to the hose or tubing 24. In FIGS. 1, 8, the tubing 24 can be pulled off the nipple by brute force. However, it does not have to be removed and replaced very many times before at least the end of the tubing is more or less destroyed.

In FIGS. 16, 17 the nipple 230 has a projection extending therefrom to form one half of a bayonet connector fitting 232. (The term "bayonet" is to be construed broadly enough to cover any and all suitable quick disconnected connectors.) A pair of studs 234, 236 project perpendicularly from opposite sides of the bayonet connector fitting 232. Water may or may not flow through the passageway 238 depending upon the position of a rotary valve 240. An O-ring 242 fits in a groove in the bayonet fitting 232 to seal together the two parts of the bayonet fitting.

The other half 244 of the bayonet fitting is seen in FIG. 18. A tube 244 has a pair of oppositely disposed L-shaped slots 246 which slip over the studs 243, 236 on the first half of the bayonet fitting 232. Then, the fitting 244 is given a small turn to capture the studs 234, 236 in the toes of the L-shaped slots 246. Hence, it is seen that bayonet connector members 232 and 244 are two telescoping tubes with a pair of studs and L-shaped seats for holding them together. Thereafter, the tubing 24 is held against the bayonet fitting 232, sealed thereto by 0-ring 242. Hence, the tubing 24, and therefore the shower shaver, may be attached to and removed from the plumbing, quickly and easily.

When the shower shaver is disconnected from the plumbing by removing the bayonet connector of FIG. 18 from the bayonet 232, the hanger 250 of FIGS. 19, 20 may be used to store the razor in any suitable location. The hanger 250 is a plastic plate which has a back plate 252 with a shelf-like plate 254 extending therefrom, at any suitable angle such as 90°–120°. A half of a "Velcro" hook and loop fastener 256 is attached to the back of the plate 252. A mating half of this "Velcro" fastener is attached to a wall at any suitable position to receive and support the hanger 250.

The shelf includes an opening 258 with an angled pair of upstanding walls or fences 260, 262 formed thereon. The angle corresponds to the contours of the shaver so that it hangs simply by resting its fan-shaped top against the fences with the handle in opening as shown 258, as shown in FIG. 20. The shelf 254 also includes a circular opening 264 with an entrance 266 through which the tubing 24 may pass while the quick disconnect bayonet 244 hangs therefrom.

Those who are skilled in the art will readily perceive how to modify the invention. Therefore, the appended claims are to be construed to cover all equivalent structures which fall within the true scope and spirit of the invention.

What is claimed is:

1. A shower shaver comprising a handle having an upper cavity and further having a channel extending from said cavity through said handle, means at a front of said cavity for supporting a razor blade, said channel having two opposite ends one of which terminates at and communicates into said cavity, a flexible tubing connected directly to said handle at an opposite end of said channel, a valve in said handle for controlling a volume of water passing through said channel, at least one orifice in said cavity for emitting water passed by said channel toward said blade, thereby bathing said blade with a fast moving stream of water, a non-threaded quick disconnect connector attached to an opposite end of said tubing, a nipple having threads on opposite ends thereof so that said nipple may be inserted between a water outlet and a plumbing pipe, a mating quick disconnect fitting on said nipple, and a valve in said nipple for selectively directing water flowing through said nipple toward either said water outlet or said tubing.

2. The shower shaver of claim 1 and a hanger comprising a back plate and a shelf, fastener means on said back plate for securing said hanger means in place, and means on said shelf for supporting said shaver and said quick disconnect connector.

3. The shower shaver of claim 2 wherein said fastener means comprises a hook and loop fastener.

4. The shower shaver of claim 1 wherein said quick disconnect connector comprises first and second telescoping tubes, one of said tubes having opposed studs extending therefrom, the other of said tubes having opposed L-shaped slots therein for receiving and capturing said studs responsive to a telescoping and a twisting of one of said tubes relative to the other of said tubes, and means for sealing the space between said tubes when they are telescoped together.

5. The shower shave of claim 1 and a pipe inside said handle and extending from said valve toward said blade, said pipe providing a straight flow of water from said valve through said channel to said blade.

6. A shower shaver comprising a handle with a channel terminating in and communication with a cavity at one end thereof, a removable and replaceable razor blade support at said one end of said cavity, said blade support being positioned to direct water issuing from said channel against a cutting edge of said blade and to bathe the user's skin with water immediately in front of said cutting edge, and a tube having a quick disconnect means on one end thereof being associated with said handle on the other end thereof for removably connecting said channel to receive a flow of water from a suitable source of pressurized water, said quick disconnect means comprises first and second telescoping tubes, one of said tubes having opposed studs extending therefrom, the other of said tubes having opposed L-shaped slots therein for receiving and capturing said studs responsive to a telescoping and a twisting of one of said tubes relative to the other of said tubes, and an O-ring for sealing the space between said tubes.

7. The shower shaver of claim 6 and a water flow control valve in said handle for selecting an amount of water passed through said channel in order to wash debris away from said blade.

8. The shower shaver of claim 7 and a pipe extending from said valve in said blade in order to provide a straight flow of water thereto.

9. The shower shaver of claim 6 and hanger means for supporting said shower shaver and said quick disconnect means when said shaver is not in use, and means for releasably supporting said hanger means in a shower stall.

10. The shower shaver of claim 9 wherein said hanger comprising a back plate and a shelf, fastener means on said back plate for securing said hanger means in place, and means on said shelf for supporting said shaver and said quick disconnect means.

11. The shower shaver of claim 10 wherein said fastener means comprises a hook and loop fastener.

12. A shower shaver comprising a handle and a cavity, means at a front of said cavity for supporting a razor blade, a channel extending from said cavity through said handle to a source of water, said channel having two opposite ends one of which terminates at and communicates into said cavity, a flexible tubing connected directly to an opposite end of said channel, a valve in said channel for controlling a volume of water passing through said channel, a pipe within said shaver, said pipe extending from said valve far enough toward said cavity to provide a straight flow of water from said valve through said channel and cavity to said blade, and at least one orifice in said cavity for emitting water passed by said channel toward said blade, thereby bathing said blade with a fast moving stream of water.

13. The shower shaver of claim 12 having a non-threaded, bayonet type of quick disconnect connector attached to an opposite end of said tubing, a nipple having threads on opposite ends thereof so that said nipple may be inserted between a water outlet and a plumbing pipe, a mating quick disconnect fitting on said nipple, and a valve in said nipple for selectively directing water flowing through said nipple toward either said water outlet or said tubing.

14. A shower shaver comprising a channel terminating in a cavity having a wide end, a plurality of orifices at a wide end of said cavity, a removable and replaceable razor blade support at said orifices, said blade support being positioned to direct water issuing from said orifices against a flat surface of said blade and under a cutting edge of said blade to bathe the user's skin with water immediately in front of said cutting edge, a long thin walled tubing coupled at one end to deliver water to and through said channel to said cavity, means coupled to an opposite end of said tubing for delivering water from a plumbing pipe through said tubing to said shaver, a valve in said channel for controlling a flow of water through said cavity toward said user's skin, and notch means near a front of said cavity for directing a spray of water toward said user's skin independently of water issuing through said orifices.

15. The shower shaver of claim 14 having a nipple attached to an opposite end of said tubing, said nipple having threads on opposite ends thereof so that said nipple may be inserted between a shower head and a plumbing pipe.

16. The shower shaver of claim 14 wherein said orifices deliver enough water to wash debris away from said blade, and said notch means delivers enough water in said spray of water toward said user's skin to prevent the water delivered from said orifice from pushing the user's skin away from said cutting edge, or from issuing from the ends of the blade.

17. The shower shaver of claim 16 wherein said notch means is under and outside of the wide part of said cavity to direct said spray of water in a pattern which substantially conforms to the width of said replaceable razor blade.

* * * * *